United States Patent [19]

Esser et al.

[11] 4,418,414

[45] Nov. 29, 1983

[54] METALLURGICAL PLASMA MELTING FURNACE

[75] Inventors: Fred Esser; Detlev Klöpper, both of Leipzig; Walter Lachner; Albrecht Krüger, both of Dresden, all of German Democratic Rep.

[73] Assignee: VEB Edelstahlwerk Freital im VEB Rohrkombinat, Freital, German Democratic Rep.

[21] Appl. No.: 126,569

[22] Filed: Mar. 3, 1980

[30] Foreign Application Priority Data

Apr. 3, 1979 [DD] German Democratic Rep. ... 211954

[51] Int. Cl.[3] ..... H05B 7/00; H05H 1/00

[52] U.S. Cl. ..... 373/24

[58] Field of Search ..... 13/1, 2, 2 P, 9; 219/121 PA

[56] References Cited

U.S. PATENT DOCUMENTS

| | | | |
|---|---|---|---|
| 4,048,436 | 9/1977 | Hiratake | 13/2 P |
| 4,082,914 | 4/1978 | Bortnichuk | 13/2 P |
| 4,129,742 | 12/1978 | Ward | 13/2 P |

*Primary Examiner*—Roy N. Envall, Jr.

[57] ABSTRACT

A metallurgical plasma melting furnace for the melting of metals and alloys is provided with a substantially cylindrical melting vessel and a plurality of plasma burners disposed in burner openings in the walls of the vessel for creating flow stable plasma arcs. The vessel includes a first vertical cylindrical domain and a second vertical cylindrical domain divided by a vertical longitudinal plane and wherein the burners are located in the first cylindrical domain facing the second cylindrical domain and positioned such that the points of intersection of the projections of the burner axes are disposed in the second cylindrical domain and the distance between the intersection points is less than the radius of the vessel.

2 Claims, 3 Drawing Figures

METALLURGICAL PLASMA MELTING FURNACE

BACKGROUND OF THE INVENTION

The present invention relates to a metallurgical plasma melting furnace for the melting of metals and metal alloys by means of high energy stable flowing plasma arcs.

It is known in the prior art to use plasma burners which are converted to operate with low temperature plasma for the melting of metals and alloys. The plasma burners are preferably arranged in a cylindrically shaped furnace, specifically in the lid and the wall of the furnace, with the location in the wall of the furnace being most preferred. In the most preferred case, the plasma burners are arranged in an offset manner so that equalization of the temperature in the metal bath can be accomplished by means of convection by creating a moment of rotation in the portions of the bath that are close to the surface with a resulting movement being created in the bath. This also creates a moment of rotation in the volume of gas above the bath resulting in a rotary movement of the gas, whereby the operation each burner disadvantageously affects the operation of the remaining burners.

To minimize the effect of the operation of each burner on the operation of the other burners, it has been known to work, in the case of a given arc current, with a plasma arc arrangement which has an abbreviated flow stabilized arc by reducing the voltage. However, the disadvantage of this is that the reduced voltage leads to a reduction of the performance and with that an increase in the time required for melting and an increase in the energy losses which derive from it.

SUMMARY OF THE INVENTION

The object of the present invention is to provide a metallurgical plasma melting furnace which achieves an increase in the energy performance by permitting an increase in the length of the plasma arcs during the melting process by means of flow stabilization of the plasma arcs for a given electrical arc current.

In accordance with the invention this object is achieved by arranging the plasma burners in the wall of a cylindrical metallurgical plasma melting furnace so that the burners are located in a first cylindrical domain and facing a second cylindrical domain divided from the first by an imaginary longitudinal plane and the burners are positioned such that the points of intersection of the projections of the burner axes are disposed in the second cylindrical domain and the distance between the intersection points is less than the radius of the furnace.

During operation of the furnace according to the invention, a forced flow is generated in the interior of the furnace by the use of a working gas to create the plasma melting torches. The arrangement of the burners effects a directionally oriented flow in the furnace. This flow is so oriented, in the areas in which the opposing plasma torches are the closest and thereby where the influences on each other are the greatest, that the working gas is led away in the fastest possible manner. This leading away is accomplished, in accordance with the invention, by the use of flow attractors such as chimneys or exhausts in the roof of the furnace located in the second cylindrical domain.

This invention will become more apparent from the following detailed description, taken in conjunction with the appended drawings, in which:

DETAILED DESCRIPTION OF THE INVENTION

Figure 1:
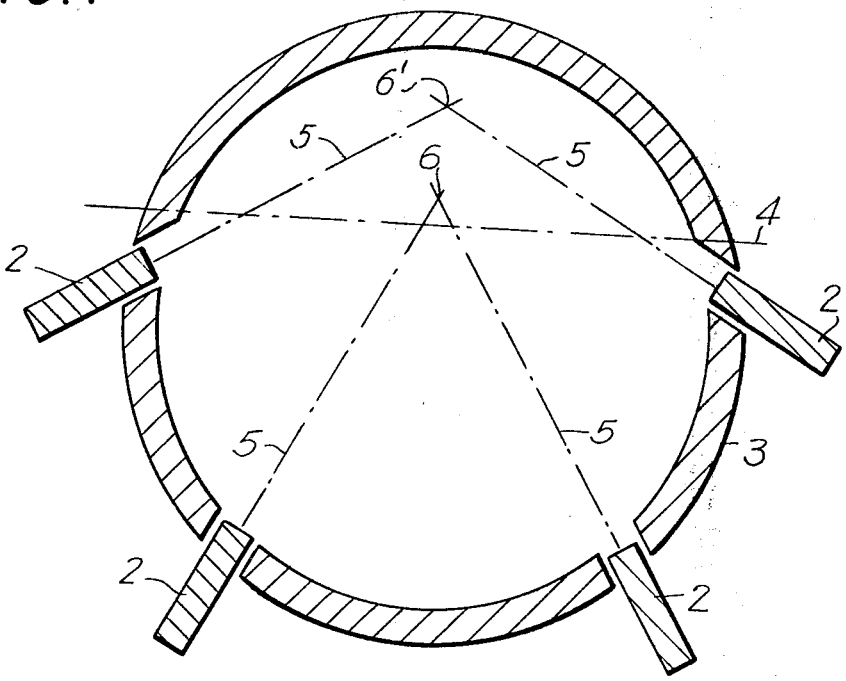
FIG. 1 is a sectional plan view of a furnace according to the invention.

FIG. 1 shows an empty plasma melting furnace 1 with the lid removed. The furnace is built in a known manner and employs a cylindrical furnace vessel 3. Plasma burners 2 are located in each of four openings in the furnace wall and extend into the furnace vessel 3. The burners 2 are so positioned that projections of the axes 5, disposed in a plane normal to the axis of the cylindrical vessel 3, intersect each other at points 6,6'. Further, the burners 2 are positioned so that all of them are situated on one side of imaginary vertical plane 4, while the points of intersection 6,6' are all situated on the other side of plane 4.

Figure 2:
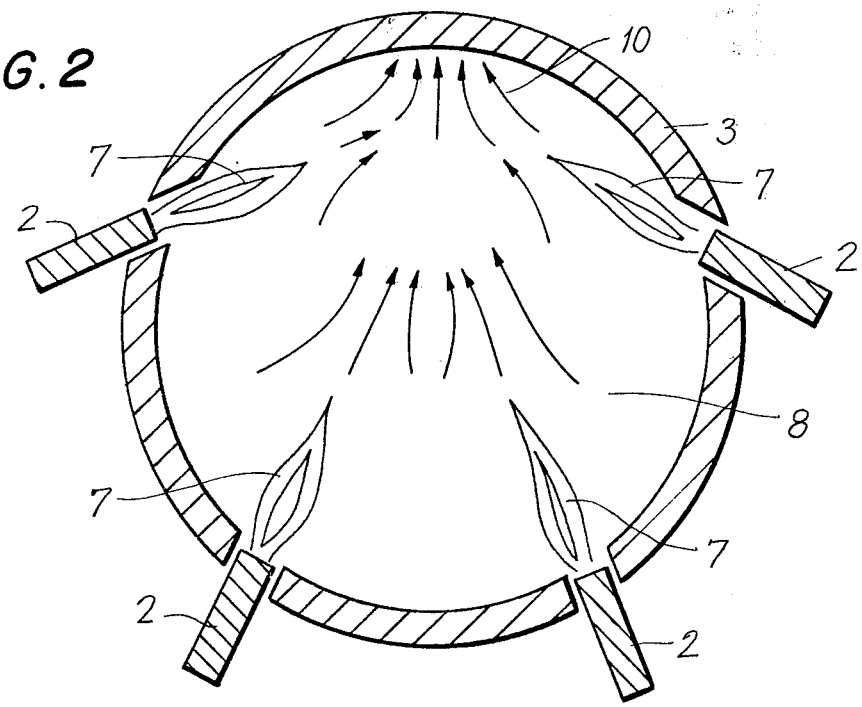
FIG. 2 is a sectional plan view of the furnace of FIG. 1 in operating condition.

FIG. 2 shows the plasma melting furnace 1 in the operating condition and filled with material 8. As shown, the length of the torch 7 for each burner 2 is determined by the vertical inclination and elevation over the surface of the bath, given the constraints of the intersection of the projections thereof in the normal plane.

Figure 3:
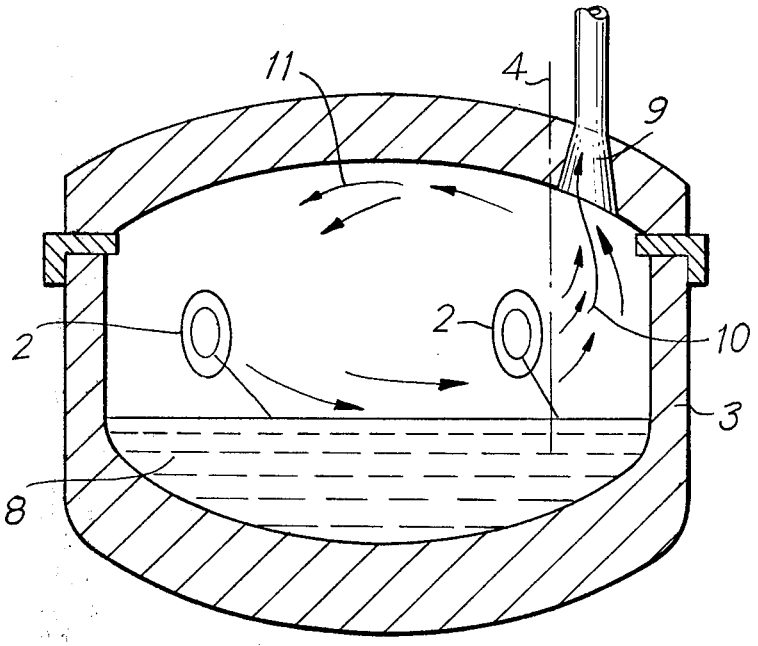
FIG. 3 is a cross-sectional view of the furnace of FIG. 2.

FIG. 3 shows the plasma melting surface 1 with an exhaust chimney 9 in the roof thereof and disposed on said other side of the imaginary plane 4, that is on the side of intersections 6,6'.

The plasma melting furnace 1 shown in FIG. 3 operates generally in a known manner. During operation, the torches 7 of the burners 2 impart a high mechanical impulse to the melt which results in a moment of rotation therein. The rotation of the melt causes a forced flow 10 of the gas in the interior of the vessel which is oriented so that the gas flows away from the burners 2. The gas flows upward along the walls of the vessel 3 and is substantially removed through the chimney 9. Any gas 11 which flow back along the roof of the furnace will hardly affect the torches 7 of the burners 2. The interaction between torches which is experienced in known arrangements is substantially reduced as a result, so that the relatively longer torches 7 will burn in a stable manner.

In the case of a given arc current, the ability to use longer torches 7 will result in the capability of increasing the voltage of the arc which enables one to increase the performance of the torches 7 and thereby a faster heating of the material to be melted.

We claim:

1. A metallurgical plasma melting furnace for the melting of metals and alloys, comprising: a substantially cylindrical melting vessel for holding a metal bath having a horizontal surface and a plurality of plasma burners disposed in burner openings in the walls of the vessel for creating flow stable plasma arcs, wherein the vessel includes a first vertical cylindrical domain and second vertical cylindrical domain divided by a vertical longitudinal plane disposed perpendicular to the bath surface and wherein the burners are located in the first cylindrical domain facing the second cylindrical domain and positioned such that the points of intersection of the projections of the burner axes are disposed in the second cylindrical domain and the distance between the intersection points is less than the radius of the vessel.

2. The furnace according to claim 1, further comprising a cover on the top of vessel having gas exhaust means located therein in the second cylindrical domain.

* * * * *